US006158361A

United States Patent [19]

Zheng et al.

[11] Patent Number: 6,158,361

[45] Date of Patent: Dec. 12, 2000

[54] FOLDABLE TABLE FRAME

[75] Inventors: Edward Zheng, Pomona, Calif.; Paul Zheng, Cang Shan Fu, China

[73] Assignee: Tofasco of America, Inc., La Verne, Calif.

[21] Appl. No.: 09/303,457

[22] Filed: Apr. 30, 1999

[51] Int. Cl.[7] ..... A47B 3/02

[52] U.S. Cl. ..... 108/118; 108/166; 248/436

[58] Field of Search ..... 108/118, 120, 108/157.15, 157.16, 162, 166, 176; 248/164, 436

[56] References Cited

U.S. PATENT DOCUMENTS

| | | | |
|---|---|---|---|
| 800,233 | 9/1905 | McConnell | 248/164 |
| 1,876,400 | 9/1932 | Cederquist | 108/118 |
| 3,136,272 | 6/1964 | Sprigman | 108/118 |
| 3,635,520 | 1/1972 | Roher et al. | 108/118 X |
| 5,645,259 | 7/1997 | Chen | 108/118 X |

FOREIGN PATENT DOCUMENTS

| | | | |
|---|---|---|---|
| 482091 | 4/1952 | Canada | 108/166 |
| 134566 | 10/1929 | Switzerland | 108/166 |
| 275127 | 7/1951 | Switzerland | 108/166 |

*Primary Examiner*—Janet M. Wilkens
*Attorney, Agent, or Firm*—Raymond Y. Chan; David and Raymond

[57] ABSTRACT

A foldable table frame includes a table support apparatus which includes a set of our tabletop support arms slidably connecting at their inner, crossing ends to two opposing tabletop support arm holders and at their outer ends pivotally connecting to four frame top joints, such that each set of two tabletop support arms opposedly face with each other and are parallel to the other set of the two tabletop support arms. The table support apparatus further includes a pair of table support pillars for providing greater stability for the table support apparatus for supporting a foldable tabletop, each connecting at its upper end between the respective pair of tabletop support arm holders and at its lower end to a foldable table frame body. The foldable table frame is arranged to allow being pushed together in one motion to fold up the foldable table frame or pulled open to unfold the foldable table frame for the foldable tabletop to mount thereon.

18 Claims, 8 Drawing Sheets

FOLDABLE TABLE FRAME

FIELD OF THE PRESENT INVENTION

The present invention relates to a foldable table frame, and more particularly a foldable table frame for supporting a portable tabletop, which may be quickly and easily folded into a compact unit for storage and unfolded for use in one motion.

BACKGROUND OF THE PRESENT INVENTION

A picnic table placed in the middle of the desert. A card table sitting in the middle of the woods. A dining table placed next to the campfire. Unless there is a private or public campground surrounding the aforementioned desert, woods, or campfire, it is unlikely that a table will be sitting there for a camper to use. Even in a campground, not every campsite has picnic tables. And for the camper that camps in a less populated area, there will certainly not be any tables around for the camper to use.

The larger the group, the more important it may be to have a table available. This is particularly true for a family of campers. That means that the camper must bring his own table. Moreover, a camper requires a table that is portable, so that he may move the item easily to the location.

Historically, the first portable table sets were one piece, tabletop and "frame," really just the legs of the table, connected together. Typically, the table was made of a non-bending stiff structure, usually metal, with legs that fold underneath and into the table. The problem with this type of conventional table is that it is bulky, usually very heavy, and difficult to carry. Also, because the "table frame" is limited to four vertical legs, either the whole set must be heavy and be of limited portability, or be lightweight and not very sturdy. Also, with this type of conventional portable table, because the table does not fold up and disconnect from the frame, or legs in this instance, a conventional portable table of the aforementioned type cannot fold up to be easily transportable in any type of car.

As a result, in today's market, the direction of the manufacturers is to provide a table frame and tabletop of greater portability. One way that this has been achieved is to construct a separate portable tabletop and separate portable table frame. The present day conventional portable table frames are collapsible, so that they are easily transportable. The second generation conventional portable table frame, however, is made up of several parts, having to be disassembled for transport or storage, and having to be reassembled for use. The present day conventional portable table frames of this type must be assembled for use out of several parts. This means the legs of the table, along with support arms for supporting the table top must be screwed or locked together when the table is used, and then taken apart when the table frame is put away. Also, typically, the support arms, whether there are two, three or four, each are one long arm, making the frame less portable. The support arm might have a hinge to allow the support arm to be bent for transport, but this design makes the frame less sturdy. Lastly, the existence of several detaching parts increases the possibility that parts of the table frame may be lost or broken, rendering the table frame and table top unusable.

A foldable table frame of the present invention meets the needs of portability, ease of use, and sturdiness that are required of present day portable tables. The foldable table frame, however, is superior to the present day tables. Unlike present day tables, the foldable table frame may be opened and closed in one easy motion, has a structure that still provides strong support for a portable table top, folds into a compact bundle for easy storage, and avoids the risk of losing parts, or parts not fitting over time, by having a one-piece structure.

SUMMARY OF THE PRESENT INVENTION

The main object of the present invention is to provide a foldable table frame for use with a portable tabletop for portable use, that requires only unfolding and folding to use and store, respectively, the foldable table frame.

Another object of the present invention is to provide a foldable table frame that does not require assembly or disassembly to use or store.

Another object of the present invention is to provide a foldable table frame comprised of lightweight but sturdy material providing adequate support for a portable tabletop.

Another object of the present invention is to provide a foldable table frame that may be used in any location without using any tools for its assembly or disassembly.

Another object of the present invention is to provide a foldable table frame that may be easily transported in any vehicle.

Another object of the present invention is to provide a foldable table frame of a simple design, such that any individual can open or close the foldable table frame.

Accordingly, in order to accomplish the above objects, the present invention provides a foldable table frame for supporting a foldable tabletop, wherein the foldable table frame comprises:

a pair of table support apparatus, each further comprising a pair of identical tabletop support arms, each tabletop support arm having outward and inward ends opposing each other and extending inwardly past each other when the foldable tabletop support arms are extended, a pair of two tabletop support arm holders slidably connected to said tabletop support arms such that the pairs of said tabletop support arms are parallel to each other, and a table support pillar for providing additional support to hold up a table top;

a foldable table frame body;

a set of four frame top joints;

the inward end of each tabletop support arm slidably connecting through one of the tabletop support arm holders of the table support apparatus;

the inward end of each tabletop support arm having a stopper integrally attaching thereby;

each tabletop support arm pivotally connecting at an end point near the outward end of the tabletop support arm to the upper surface of a frame top joint and the frame top joint having an indentation at least as wide as the tabletop support arm for allowing the tabletop support arm to pivot downward when the foldable table frame is collapsed to a folded state;

the frame top joints pivotally connecting to the top of the foldable table frame body;

the bottom end of each support arm pillar pivotally connecting to the foldable table frame body;

the tabletop support arm holders pivotally connecting to the top end of the support arm pillar situated between the pair of tabletop support arm holders in such a manner as to allow each tabletop support arm to slide inward, from a position in the tabletop support arm holder that is parallel to the ground when the foldable table frame is in the open state, to a downward position when the foldable table frame is in the folded state;

each of the pair of tabletop support arm holders of each table support apparatus pivotally rotating in opposing directions away from the outward end of the respective tabletop support arm, thereof, in such a manner as to allow the tabletop support arms to move downward and inward through the support arm holders when the foldable table frame is collapsed to the folded state;

each tabletop support arm sliding outward from a downward position, when the foldable table frame is opened from the closed state, to a horizontal position when the foldable table frame is in the open state; and each of the pair of tabletop support arm holders of each table support apparatus pivotally rotating in opposing directions toward the outward end of the respective tabletop support arm thereof, in such a manner as to allow the tabletop support arms to move upward and outward through the support arm holders when the foldable table frame is opened to the open state, until the support arm stopper is stopped by the support arm holder.

DETAILED DESCRIPTION OF THE PREFERRED EMBODIMENT

Figure 1:
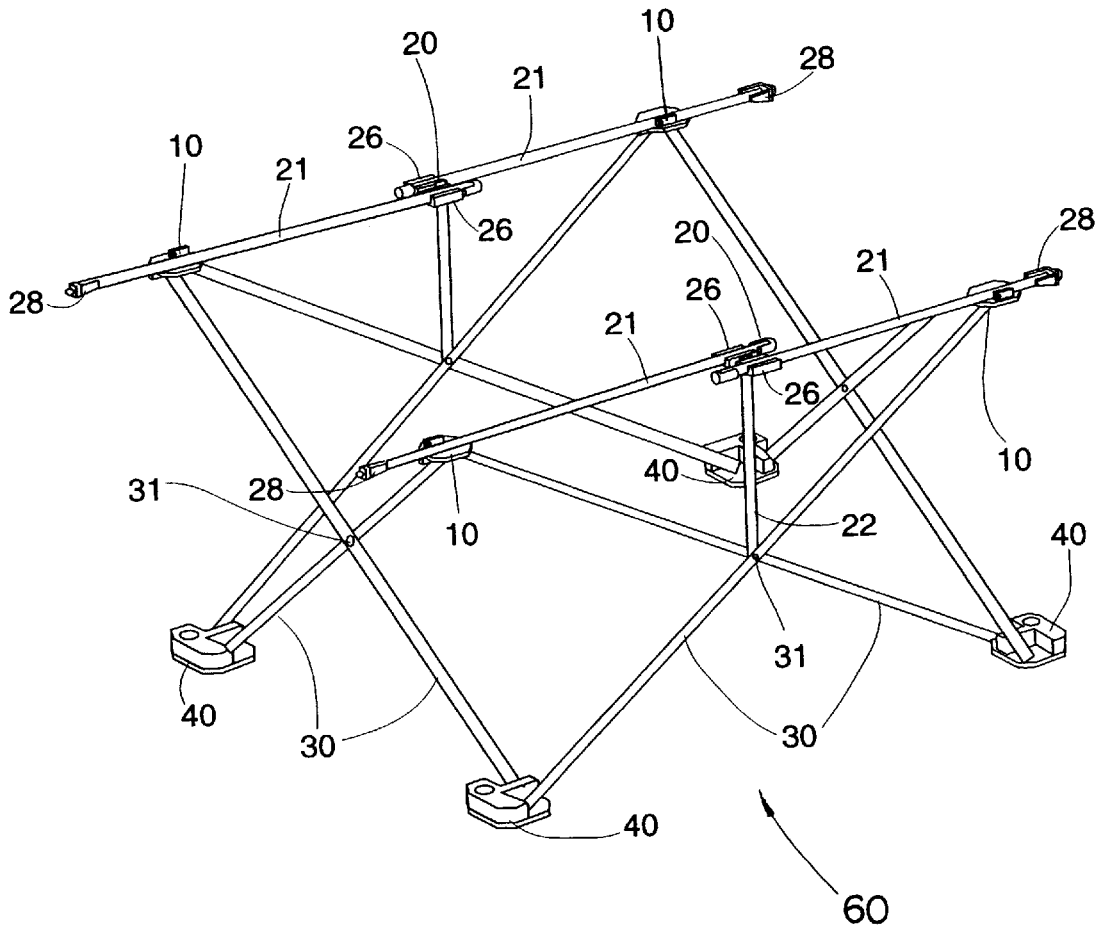
FIG. 1 is a perspective view of a foldable table frame in the open state according to a preferred embodiment of the present invention.
Figure 2:
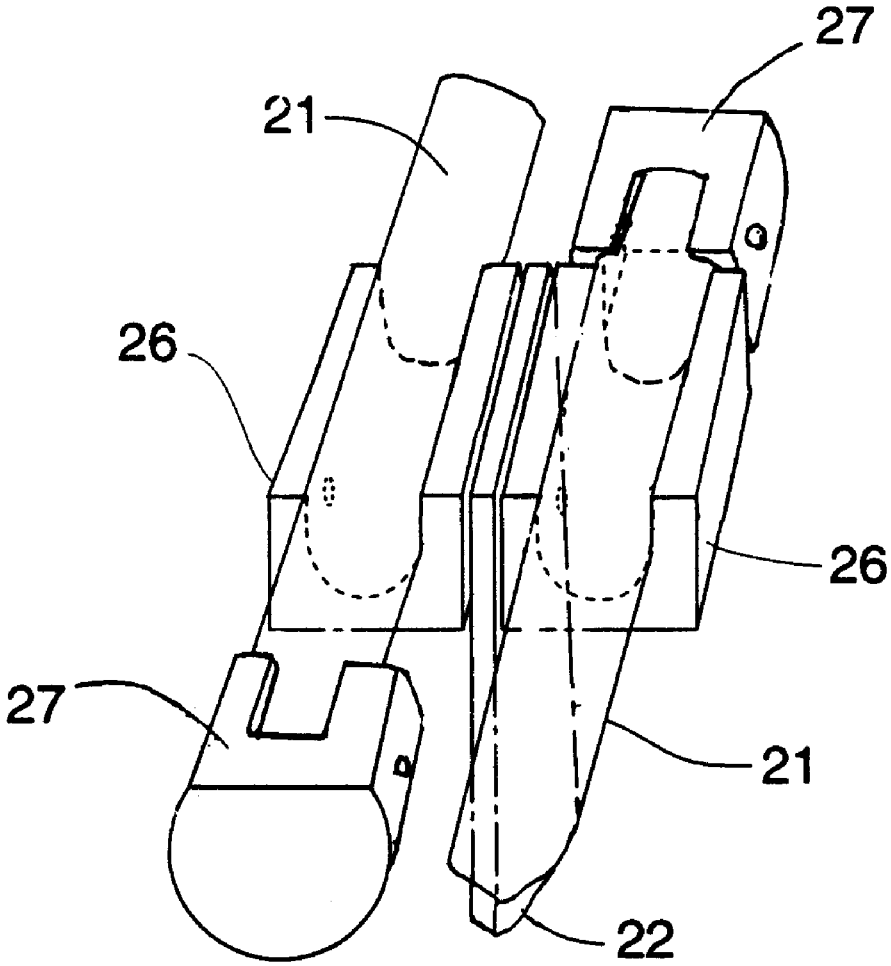
FIG. 2 is a perspective view of the tabletop support arm hinge of a foldable table frame in the open state according to the above preferred embodiment of the present invention.

Referring to FIGS. 1 to 3 and FIG. 6 of the drawings, the preferred embodiment of a foldable table frame of the present invention comprises two table support apparatuses 20, four frame top joints 10, and a table frame body 60 further comprising four identical sets of a first and second table frame legs 30, four leg frame connecting means 31 and four frame base pads 40.

Each of the table support apparatus 20 further comprises a pair of tabletop support arms 21, two tabletop support arm holders 26, and a vertical support arm pillar 22. The support arm pillar 22 integrally connects at a lower end thereof to the leg frame connecting means 31 that pivotally connects respective set of the first and second table frame legs 30. Two tabletop support arm holders 26 pivotally connect, respectively, to an inner side and an outer side of a top end of the support arm pillar 22.

The tabletop support arms 21 are in two pairs. Each tabletop support arm 21 of each pair of tabletop support arms 21 has an outward end point pivotally connected to a vertical extension 111 on an upper surface of opposing frame top joints 10, and an inward end extending inwardly to slidably connect through one of the tabletop support arm holders 26 of the table support apparatus 20. The inward end of each of the table support arms 21 integrally connects with a tabletop support arm stopper 27. Each pair of tabletop support arms 21 therefore slidably rest horizontally in parallel above opposing pairs of first and second table frame legs 30. The outward end of each tabletop support arm 21 of each pair of tabletop support arms 21 extends outwardly at least as far as the circumference defined by the table frame body 60 formed by the four pairs of first and second table frame legs 30. At the outward end of each tabletop support arm 21 is a tabletop securing extension 28 which comprises a rounded knob connected thereto.

The vertical support arm pillar 22 strengthens the horizontal tabletop support arms 21 to support a tabletop 50 when the tabletop 50 is placed on top of the foldable table frame in the open state.

Figure 3:
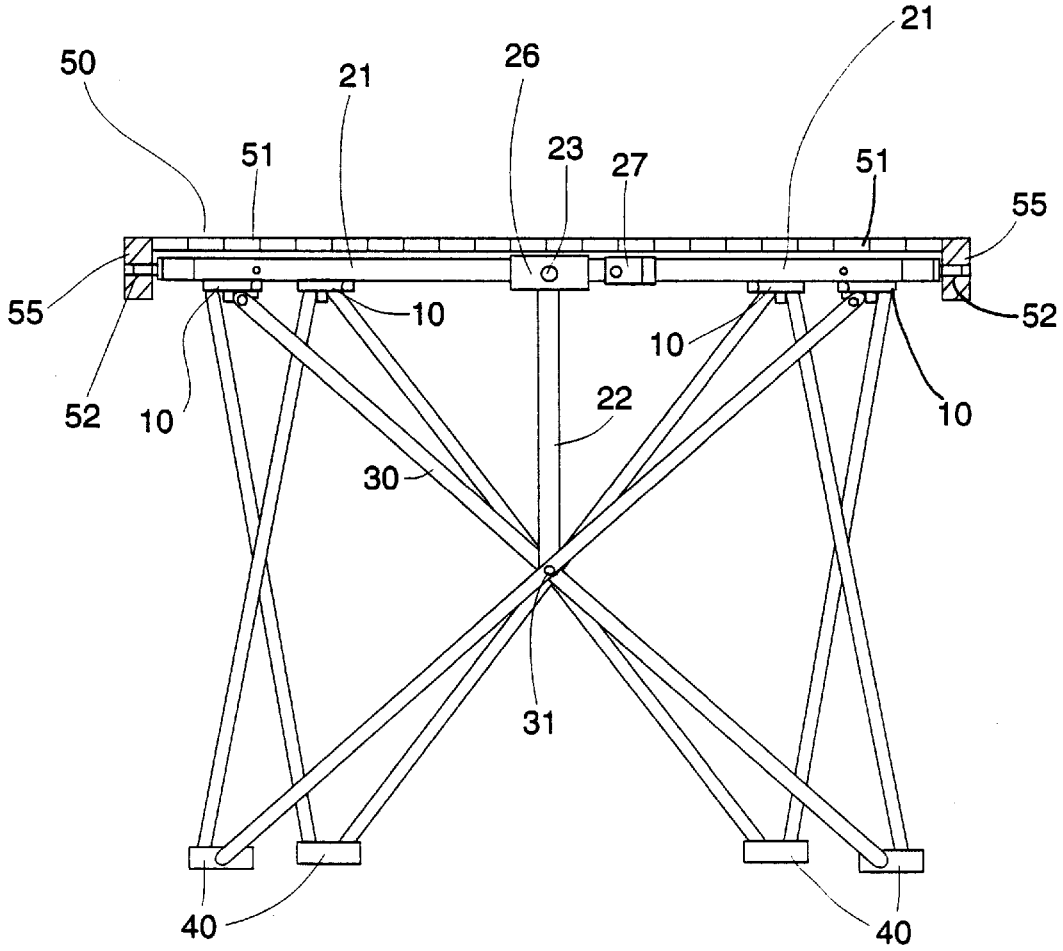
FIG. 3 is a side view of a foldable table frame in the open state according to the above preferred embodiment of the present invention and a first embodiment of a foldable tabletop.
Figure 5:
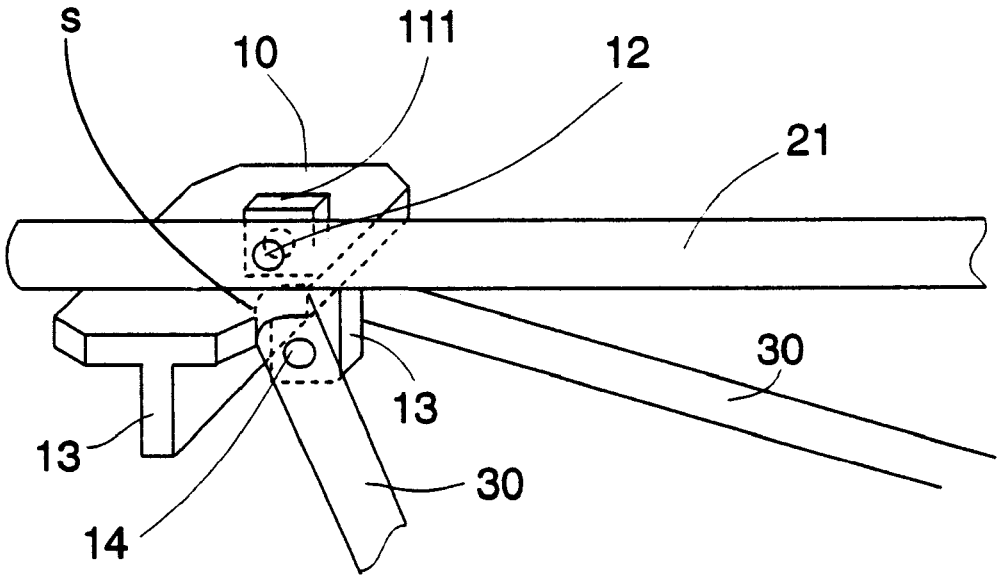
FIG. 5 is a side view of a frame top hinge of a foldable table frame in the open state according to the above preferred embodiment of the present invention.
Figure 6:
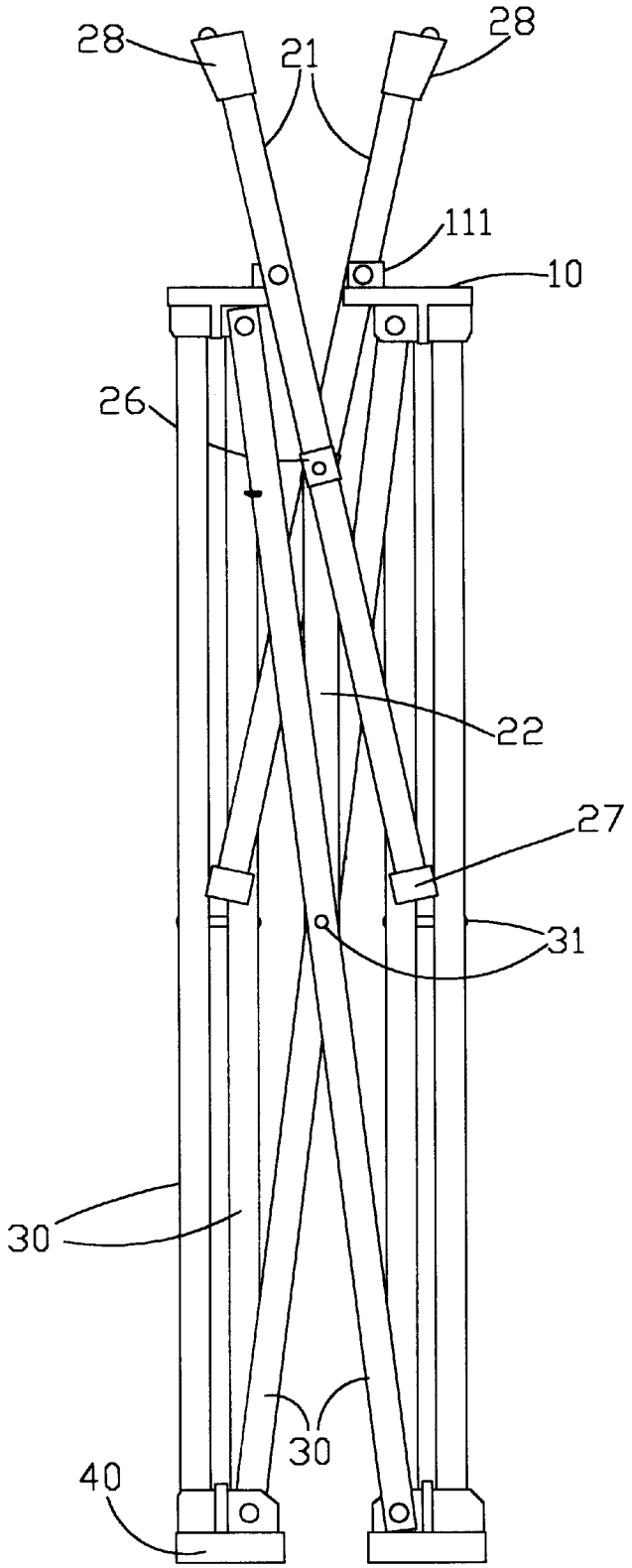
FIG. 6 is a side view of a foldable table frame in the folded state according to the above preferred embodiment of the present invention.
Figure 7:
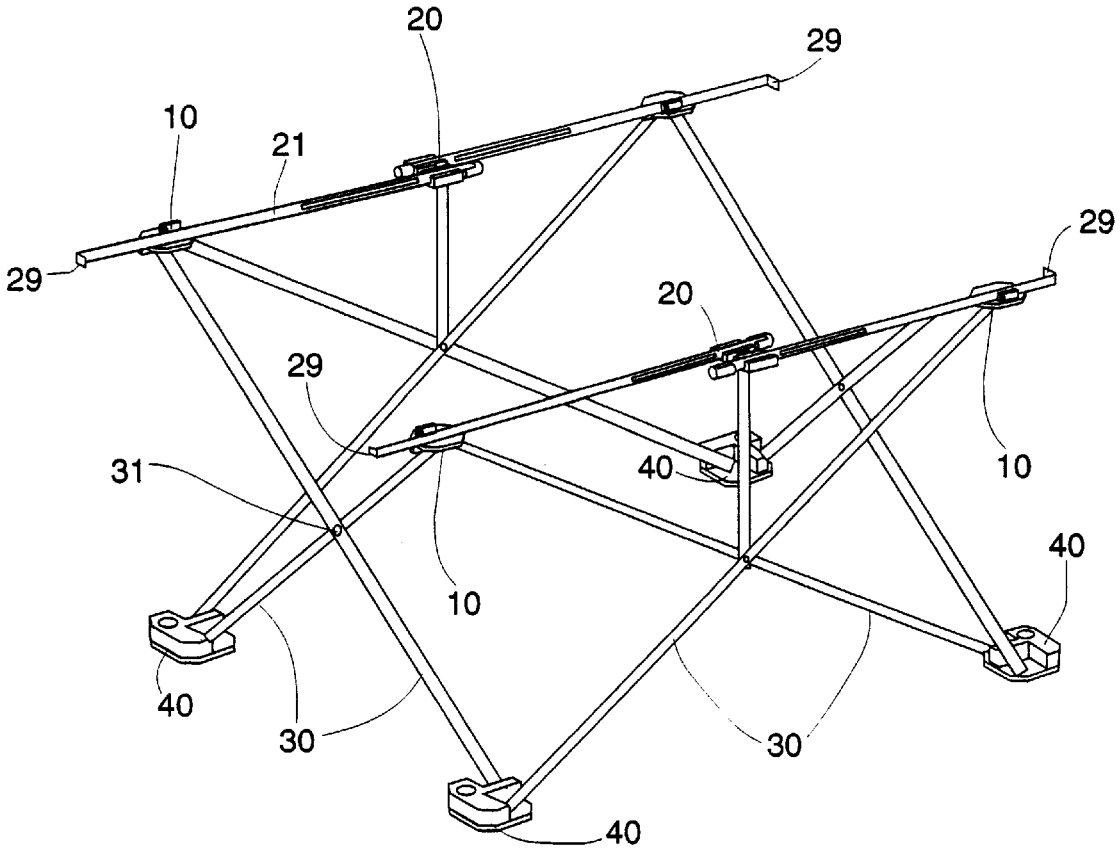
FIG. 7 is a perspective view of a foldable table frame in the open state according to a second alternative embodiment.

As shown in FIGS. 1, 3, and 6, each pair of the first and second table frame legs 30 pivotally connect together by the leg frame connecting means 31 at a same point on each first and second table frame legs 30 to form a cross structure. When the foldable table frame is in an open state, the four pairs of table frame legs 30 stand diagonally, in the cross structure. As shown in FIGS. 1 and 7, the four pairs of first and second table frame legs 30 form a square shape. Each of the first and second table frame legs 30 is connected at a top end thereof to a bottom surface extension 13 of a frame top joint 10, as shown in FIG. 5, and at its bottom end to a frame base pad 40. There are therefore four frame top joints 10 and four frame base pads 40, as shown in FIGS. 1 and 3, located at each corner of the square formed by the first and second table frame legs 30 of the foldable table frame in the open state.

Each of the frame base pads 40 therefore connects to a first or second table frame leg 30 of one pair of first and second table frame legs 30, and connects to a second or first table frame leg 30, respectively, of an adjoining pair of first and second table frame legs 30, such that each table frame leg 30 may pivot around the connection between the table frame leg 30 and frame base pad 40 and along the respective planes formed by each pair of table frame legs 30, as the foldable frame is opened and closed.

Each frame top joint 10 pivotally connects on it's lower surface to the upper ends of the two legs of adjoining pairs of first and second table frame legs 30 that do not connect to the frame base pad 40 directly below the frame top joint 10. For example, if the first table frame leg 30 connects at its lower end to a frame base pad 40, then the upper end of the second frame leg 30 of the same pair connects to the frame top joint 10 which sits directly above it.

As the foldable table frame is closed, as shown in FIG. 6 the table frame legs 30 pivot about the table frame legs connecting means 31 in a scissors-like manner. For each table supporting apparatus 20, the tabletop support arms 21 pivotally fold downward. To enable the tabletop support arms 21 to fold downward, for each pair of tabletop support arm holders 26, the two tabletop support arm holders 26 rotate downward, towards the inward ends of the respective support arm 21, and therefore, the two tabletop support arm holders 26 rotate in opposite directions. The tabletop support arms 21 slide inwardly and downwardly as the foldable table frame is collapsed. FIG. 6 illustrates a foldable table frame in a closed state.

Referring to FIG. 5, each of the frame top joints 10 has an indentation S on its edge directly underneath the connecting tabletop support arm 21, at least the width of the tabletop support arm 21, to allow the tabletop support arms 21 to pivotally fold downward when the foldable table frame is collapsed. Referring to FIG. 6, when the foldable table frame is folded up, the tabletop support arms 21 may rotate downwardly to align with the indentation S. When folded up, the tabletop support arms 21 also respectively slide inwardly through the tabletop support arm holders 26 of the tabletop support arm joint 20 to a near vertical position. When the foldable table frame is folded, the table frame legs 30 rotate in a scissors-like manner, narrowing the cross structure of each pair of first and second frame legs 30 to a near vertical position, as the circumference of the foldable table frame is reduced and the height is lengthened.

Figure 4:
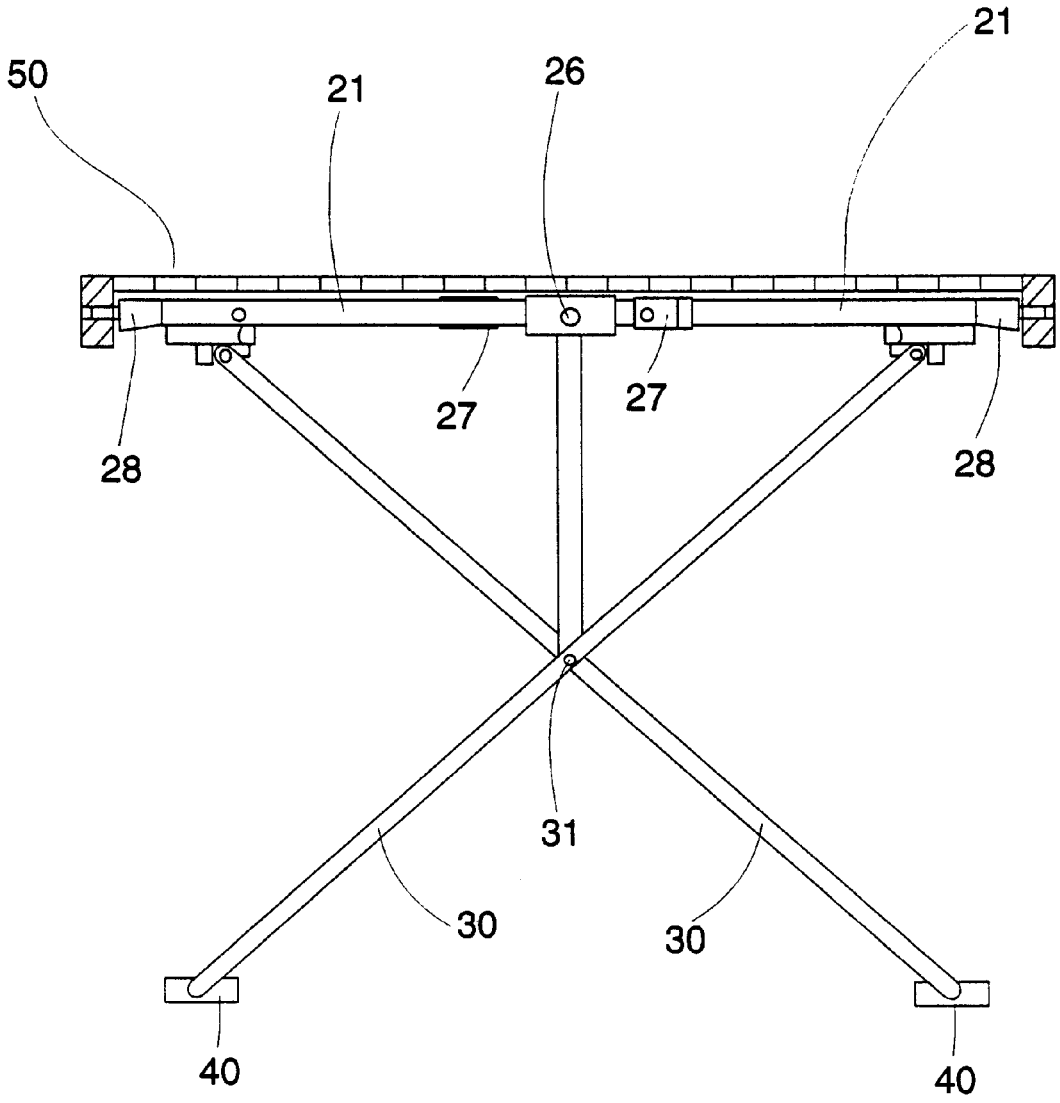
FIG. 4 is a side view of a foldable table frame in the open state according to a first alternative embodiment of the present invention and the above first embodiment of a foldable tabletop.

As illustrated by FIG. 4, a first alternative embodiment of a foldable table frame of the present invention has only two opposing pairs of first and second table frame legs 30, the first and second pairs of table frame legs 30 connecting by a frame body connecting means 31 and the two pairs of the tabletop arms 21 are aligned along the respective vertical planes of each of the two sets of first and second table frame legs 30.

As shown in FIG. 3, the first embodiment of a tabletop 50 that is used with a foldable table frame comprises a plurality of longitudinal strips 51 made of hard tensile material and a flexible connecting means for holding the longitudinal strips 51 made of hard tensile material together, while allowing the longitudinal strips 51 to be folded or rolled up when the tabletop 50 is not used, and initially stretched when the tabletop 50 is placed on, and attached to, the foldable table frame of the present invention. The longitudinal strips 51 of the tabletop 50 of the first embodiment of the tabletop 50 further comprises of two vertical end strips 55, each vertical end strip 55 adjoiningly connecting to the outer part of the bottom surface of outermost longitudinal strip 51 at a ninety degree angle for fitting over the tabletop support arms 21. Each vertical end strip 55 of the first embodiment of the tabletop 50 having defined a set of throughholes 52, one near each endpoint of the vertical end strip 55 lined up with the outward ends of the tabletop support arms 21 thereby allowing the tabletop 50 to be stretched over the foldable table frame onto the tabletop securing extensions 28 of the tabletop support arms 21, fittingly connecting to each tabletop securing extension 28 to the corresponding throughhole 52 of the tabletop 50.

As illustrated in FIG. 7, it is anticipated that the outward ends of the tabletop support arms 21 may fold over near the outward end point of the tabletop support arms 21, forming a set of folded over ends 29, in such a manner as to connectingly attach over the folded over ends of the tabletop support arms 21.

Figure 8:
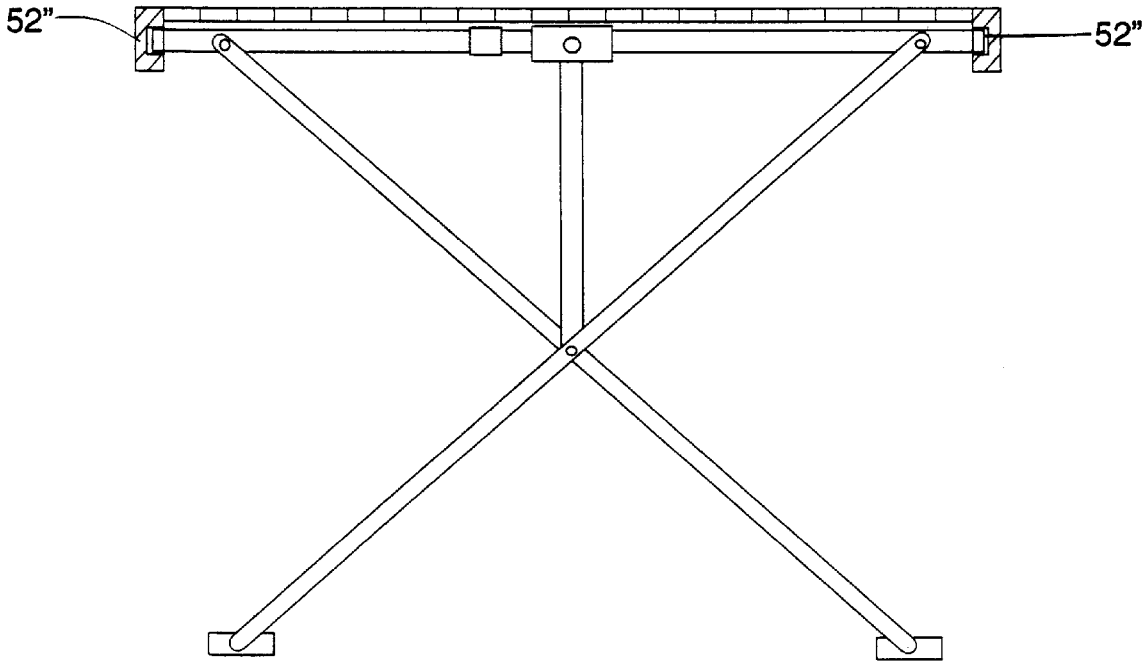
FIG. 8 is a side view of a foldable table frame in the open state according to the above second alternative embodiment and second embodiment of a foldable tabletop.

As shown in FIG. 8, it is further anticipated that the foldable tabletop 50 of a second embodiment may have defined holes 52" instead of throughholes 52 therein, so as to allow the outward ends of the tabletop support arms 21 of a foldable frame of the second alternative embodiment to connectingly attach to the indentations 52" of the vertical end strips 55, connecting the foldable table frame to the foldable table top.

What is claimed is:

1. A foldable table frame for supporting a tabletop thereon, comprising:

a foldable table frame body;

two pairs of frame top joints pivotally connected to a top of said foldable table frame body; and a pair of table support apparatus, each comprising a pair of table support arms, two tabletop support arm holders and a vertical support arm pillar for supporting said two tabletop support arm holders respectively, each of said table support arms having an outward end and an inward end connected with a tabletop support arm stopper;

wherein said four table support arms further have four outward end points adjacent to said four outward end thereof, which are pivotally connected to four upper surfaces of said four frame top joints respectively, and that each of said four frame top joints has an indentation at least as wide as each of said tabletop support arms for allowing said respective tabletop support arm to pivot downward when said foldable table frame is folded up, wherein said two inward ends of each pair of said table support arms are respectively extended inwardly to slidably connect through one of said tabletop support arm holders of said table support apparatus, wherein each pair of said table support arms slidably rest horizontally in parallel with each other, wherein two bottom ends of said two support arm pillars are pivotally connected to said foldable table frame body, wherein said two tabletop support arm holders of each of said two pairs of tabletop support arm holders are pivotally connected to two sides of a top end of said respective support arm pillar respectively so as to situate a top end of said respective support arm between said respective pair of tabletop support arm holders in such a manner as to allow said four tabletop support arms sliding through said four tabletop support arm holders respectively;

wherein in order to fold up said foldable table frame, said four tabletop support arms are folded downwards by downwardly rotating said two pairs of tabletop support arm holders towards said inward ends of said tabletop support arms respectively, so that each of said two pairs of said tabletop support arm holders rotates in opposite directions and said four tabletop support arms slide inwardly and downwardly to a downward position as said foldable table frame is collapsed, wherein in order to unfold said foldable table frame, each of said tabletop support arms slides outward from said downward position to a horizontal position, and each of said two pairs of tabletop support arm holders pivotally rotate in opposite directions towards said outward ends of said two respective tabletop support arms respectively, so as to allow said four tabletop support arms to move upwardly and outwardly through said four tabletop support arm holders respectively until said four tabletop support arm stoppers are stopped by said four tabletop support arm holders respectively.

2. The foldable table frame, as recited in claim 1, wherein each of said tabletop support arms further comprises a table securing extension integrally connected to said outward end thereof for attaching said tabletop placed on top of said foldable table frame.

3. The foldable table frame, as recited in claim 2, wherein said foldable table frame body comprises:

four pairs of first and second table frame legs, wherein each of said pairs of first and second table frame legs is pivotally connected together in a cross pattern by a leg frame connecting means in such a manner that said first and second table frame legs are capable of opposedly rotating about said leg frame connecting means to a vertical position when folding up said foldable table frame, wherein each of said four frame top joints is pivotally connected with top ends of one of said first table frame legs and one of said second table frame legs; and four frame base pads adapted for stabilizing said foldable table frame, wherein said four frame base pads are located directly under said four frame top joints respectively, and each of said frame base pads is pivotally connected with bottom ends of one of said first table frame legs and one of said second table frame legs by means of a base connecting means.

4. The foldable table frame, as recited in claim 3, wherein said two bottom ends of said two support arm pillars are pivotally connected to two of said leg frame connecting means which are opposing with each other respectively.

5. The foldable table frame, as recited in claim 4, wherein each of said table securing extensions comprises a rounded knob.

6. The foldable table frame, as recited in claim 4, wherein each of said table securing extensions comprises an extension integrally connecting to said outward end of said respective tabletop support arm at a 90 degree angle.

7. The foldable table frame, as recited in claim 6, being combined with a tabletop, wherein the tabletop is placed on top of said foldable table frame and comprises:

a plurality of longitudinal strips, made of hard and tensile material, including two side strips and a plurality of middle strips connected one by one between said two side strips in such a manner that said longitudinal strips are capable of folding up when said tabletop is not in use; and two end strips each adjoiningly connecting to a bottom surface of said respective side strip, each of said end strips having two through holes provided at two end portions thereof respectively, wherein said four through holes of said two end strips are arranged to fittingly connect with said four tabletop securing extensions of said four tabletop support arms when said tabletop is stretched over said foldable table frame.

8. The foldable table frame, as recited in claim 4, being combined with a tabletop, wherein the tabletop is placed on top of said foldable table frame and comprises:

a plurality of longitudinal strips, made of hard and tensile material, including two side strips in such a manner that said longitudinal strips are capable of folding up when said tabletop is not in use; and two end strips each adjoiningly connecting to a bottom surface of said respective side strip, each of said end strips having two through holes provided at two end portions thereof respectively, wherein said four through holes of said two end strips are arranged to fittingly connect with said four tabletop securing extensions of said four tabletop support arms when said tabletop is stretched over said foldable table frame.

9. The foldable table frame, as recited in claim 3, wherein each of said table securing extensions comprises a rounded knob.

10. The foldable table frame, as recited in claim 3, wherein each of said table securing extensions comprises an extension integrally connecting to said outward end of said respective tabletop support arm at a 90 degree angle.

11. The foldable table frame, as recited in claim 10, being combined with a tabletop, wherein the tabletop is placed on top of said foldable table frame and comprises:

a plurality of longitudinal strips, made of hard and tensile material, including two side strips and a plurality of middle strips connected one by one between said two side strips in such a manner that said longitudinal strips are capable of folding up when said tabletop is not in use; and two end strips each adjoiningly connecting to a bottom surface of said respective side strip, each of said end strips having two through holes provided at two end portions thereof respectively, wherein said four through holes of said two end strips are arranged to fittingly connect with said four tabletop securing extensions of said four tabletop support arms when said tabletop is stretched over said foldable table frame.

12. The foldable table frame, as recited in claim 3, being combined with a tabletop, wherein the tabletop is placed on top of said foldable table frame and comprises:

a plurality of longitudinal strips, made of hard and tensile material, including two side strips and a plurality of middle strips connected one by one between said two side strips in such a manner that said longitudinal strips are capable of folding up when said tabletop is not in use; and two end strips each adjoiningly connecting to a bottom surface of said respective side strip, each of said end strips having two through holes provided at two end portions thereof respectively, wherein said four through holes of said two end strips are arranged to fittingly connect with said four tabletop securing extensions of said four tabletop support arms when said tabletop is stretched over said foldable table frame.

13. The foldable table frame, as recited in claim 2, wherein each of said table securing extensions comprises a rounded knob.

14. The foldable table frame, as recited in claim 2, wherein each of said table securing extensions comprises an extension integrally connecting to said outward end of said respective tabletop support arm at a 90 degree angle.

15. The foldable table frame, as recited in claim 14, being combined with a tabletop, wherein the tabletop is placed on top of said foldable table frame and comprises:

a plurality of longitudinal strips, made of hard and tensile material, including two side strips and a plurality of middle strips connected one by one between said two side strips in such a manner that said longitudinal strips are capable of folding up when said tabletop is not in use; and two end strips each adjoiningly connecting to a bottom surface of said respective side strip, each of said end strips having two through holes provided at two end portions thereof respectively, wherein said four through holes of said two end strips are arranged to fittingly connect with said four tabletop securing extensions of said four tabletop support arms when said tabletop is stretched over said foldable table frame.

16. The foldable table frame, as recited in claim 12, being combined with a tabletop, wherein the tabletop is placed on top of said foldable table frame and comprises:

a plurality of longitudinal strips, made of hard and tensile material, including two side strips and a plurality of middle strips connected one by one between said two side strips in such a manner that said longitudinal strips are capable of folding up when said tabletop is not in use; and two end strips each adjoiningly connecting to a bottom surface of said respective side strip, each of said end strips having two through holes provided at two end portions thereof respectively, wherein said four through holes of said two end strips are arranged to fittingly connect with said four tabletop securing extensions of said four tabletop support arms when said tabletop is stretched over said foldable table frame.

17. The foldable table frame, as recited in claim 1, wherein said foldable table frame body comprises:

four pairs of first and second table frame legs, wherein each of said pairs of first and second table frame legs is pivotally connected together in a cross pattern by a leg frame connecting means in such a manner that said first and second table frame legs are capable of opposedly rotating about said leg frame connecting means to a vertical position when folding up said foldable table frame, wherein each of said four frame top joints is pivotally connected with top ends of one of said first table frame legs and one of said second table frame legs; and four frame base pads adapted for stabilizing said foldable table frame, wherein said four frame base pads are located directly under said four frame top joints respectively, and each of said frame base pads is pivotally connected with bottom ends of one of said first table frame legs and one of said second table frame leg by means of a base connecting means.

18. The foldable table frame, as recited in claim 17, wherein said two bottom ends of said two support arm pillars are pivotally connected to two of said leg frame connecting means which are opposing with each other respectively.

* * * * *